United States Patent [19]

Kline

[11] 4,411,762

[45] Oct. 25, 1983

[54] TITANIUM CLAD COPPER ELECTRODE AND METHOD FOR MAKING

[75] Inventor: George A. Kline, Madison, Ohio

[73] Assignee: Diamond Shamrock Corporation, Dallas, Tex.

[21] Appl. No.: 319,702

[22] Filed: Nov. 9, 1981

[51] Int. Cl.[3] ..... C25B 11/00; C25D 3/66

[52] U.S. Cl. ..... 204/290 F; 204/39; 502/101

[58] Field of Search ..... 204/290 R, 290 H, 290 F, 204/39; 252/425.3

[56] References Cited

U.S. PATENT DOCUMENTS

| | | | |
|---|---|---|---|
| 2,876,180 | 5/1959 | Burwell et al. | 204/64 |
| 3,444,658 | 5/1969 | Mellors et al. | 204/71 |
| 3,503,799 | 3/1970 | Aoki | 204/290 H |

FOREIGN PATENT DOCUMENTS

| | | |
|---|---|---|
| 688546 | 3/1965 | Canada . |
| 163961 | 8/1960 | Czechoslovakia . |
| 2075857 | 7/1969 | France . |

OTHER PUBLICATIONS

Journal of the Electrochemical Society, 102, p. 641 (1955).

Science, 153, p. 1475 (1966).

Journal of the Electrochemical Society, 99, p. 223c (1952).

Scientific American, 221, (2), p. 38 (2969).

Metallurgical Reviews, 106, p. 97 (1966).

Journal of the Electrochemical Society, 113, p. 60 (1966).

*Primary Examiner*—John F. Niebling

*Attorney, Agent, or Firm*—Woodrow W. Ban

[57] ABSTRACT

A titanium clad electrode and a method for making, the electrode having a conductive, substantially pure metal substrate, a substantially pure valve metal coating substrate, a substantially pure valve metal coating and at least one zone of interdiffusion between the substantially pure metals. The coating is applied using fused salt electrolyte electrodeposition techniques.

29 Claims, 4 Drawing Figures

TITANIUM CLAD COPPER ELECTRODE AND METHOD FOR MAKING

FIELD OF THE INVENTION

This invention relates to the manufacture of electrodes and particularly to the manufacture by the process of interdiffusion electrodeposition upon electrodes having a conductive substrate of a passivating or valve metal type protective coating or cladding.

BACKGROUND OF THE INVENTION

Chlorine and other halogens are frequently generated by an electrolysis of a brine of a salt of the halogen. Generally the salt is one of an alkali metal and the halogen. Cells used for this electrolytic process are subjected to a harsh chemical environment. Caustic products being produced in the cell, the brine and the halogen being produced, together can cause a short service life for cell mechanical components. Particularly for electrodes such as the cell anode, where chlorine is evolved during electrolysis, service life can be troublesome.

While previously a relatively inert material for use in fabricating anodes for use in these cells was the subject of diligent search, more recently electrodes fabricated from passivating or so-called valve metals have found wide acceptance in the generation of halogen by electrolysis. These valve metals commonly are considered to be titanium, tantalum, tungsten, bismuth, aluminum, niobium, zirconium and mixtures of these metals. Generally, the valve metals tend to form a surface barrier layer when exposed to oxidants that tend to protect the valve metal from further damage. Often this barrier layer is not significantly electrically conductive.

One valve metal finding broad acceptance for fabricating electrodes for use in halogen generation cells is titanium. Titanium withstands corrosive effects of the cell environment well and is, at least relative to the other valve metals, suitably resistant to corrosive effects of halogen generating cells. Titanium offers relative availability and cost advantages as a metal for use in fabricating chlorine cell components. On an absolute scale, however, titanium remains relatively expensive, and where a large number of electrodes are required for use in a halogen generating plant, for example, the cost can be substantial.

Another drawback to titanium is the electrical conductivity of the metal, much less than copper, gold and silver and considerably less than baser metals such as iron and nickel. When titanium is used to fabricate particularly a reticulate electrode widely used for halogen production, considerable care is required to ensure an adequate electrical current distribution throughout the reticulate structure. An adequate current distribution can result in a relatively elevated power inefficiency due to resistance losses as electrical current passes through the reticulate structure. Where the reticulate structure is fabricated from a relatively conductive substrate having a coating of the valve metal for protection, considerable cost savings are available both in titanium and in attachment of the reticulate electrode to a current feeder used to distribute electrical current.

Past proposals have attempted to provide titanium coated conductive substrates for use as an electrode by electolytic deposition of titanium in an aqueous electrolyte. These coatings have generally been unsatisfactory where used in a halogen generating electrolysis cell.

Contamination of the titanium coating, non-uniform thickness, relatively poor adhesion to the substrate, and small crystal size are among explanations offered for failures of these titanium coatings giving rise to the dissatisfaction.

In another past proposal, pressure cladding of the substrate with titanium was proposed to provide an effective coating. Cladding is the application of one metal to the surface of another using, generally, pressure to create an interdiffused zone between metal at the surface of the substrate and the coating metal. This interdiffused zone includes one or more alloys of the substrate metal and the cladding metal, the metals intertwined in a progression of crystal states corresponding to progressive changes in composition through the zone. This interdiffusion effect can strengthen bonding between the substrate and cladding metal promoting adherence.

In forming reticulate type electrodes, particularly pressure cladding can produce a less than satisfactory result. Particularly at corners or edges of a mesh screening used for reticulate type electrodes, this pressure cladding technique can produce less than a satisfactorily integrated coating. Where pores, or other irregularities are present in a coating, attack on the substrate by contents of the electrolytic cell can quickly cause spalling of coating around the irregularity leading to rapid electrode failure.

Techniques are known for the formation of interdiffused coatings upon a substrate using electrodeposition from a fused salt electrolysis bath such as "Flinak" an eutectic mixture of lithium, sodium and potassium fluoride having a melting point of about 454° C. Such techniques are shown and described in U.S. Pat. No. 3,479,159, French 1st Publication (Brevet) No. 2,075,857, and in 221 Scientific American 38 (1969). These references generally describe methods for forming solid solutions of coating metal on the substrate and intermetallics of the coating and substrate, but do not describe desirably adequate techniques for providing a relatively pure coating of a first metal on a relatively pure second metal substrate with one or more interdiffused zones between the relatively pure metals.

A solid solution is a homogeneous crystalline phase composed of at least two distinct chemical species occupying lattice or interlattice points within a crystalline structure at random. These solutions, for a given species pair, can exist in a range of species concentration.

Intermetallic compounds, also known by the terms Hume-Rothery or electron compounds, are alloys of usually two metals wherein a progressive change in composition of the alloy is accompanied by a progression of phases, each phase, generally differing in crystalline structure.

Generally in these solid solution or intermetallic compounds, hereinafter called alloys or interdiffused alloys for convenience, one of the component metals is possessed of a somewhat greater activity as manifested by a corresponding activity coefficient than the other metal. This more active metal is generally applied second.

However, in an electrolytic cell, the composition of any solid solution at the surface of an electrode coating contacting the cell environment can be critical. Where this coating surface includes a significant substrate metal content as an interdiffused alloy at the surface, the electrode may enjoy only a foreshortened lifespan in the corrosive cell environment. Conversely, where the coating surface can be maintained substantially free of the substrate metal, electrode life spans are less likely to be negatively influenced by the presence of the substrate metal.

DISCLOSURE OF THE INVENTION

The present invention provides a method for making an interdiffused coating of a valve metal on a conductive metal substrate whereby surface portions of the coating are substantially free of the substrate metal. In the process, the substrate is immersed in a fused salt electrolysis bath containing the valve metal and made cathodic so that the valve metal electrodeposits upon the substrate. The temperature of the bath is controlled during electrodeposition to be in a range greater than the melting point of the fused salt, at least about 460° C. and yet not greater than a temperature known as the alpha-beta transition temperature for solid solutions or interdiffused phases of the valve metal and the substrate. Electrodeposition is performed under an inerted atmosphere and at a current density measured at the substrate being coated of not more than about 100 milliamperes per square centimeter. Electrodeposition is continued until a desired coating thickness is achieved, but not generally in excess of about 10 mils.

In preferred embodiments, the bath temperature is maintained to be in a temperature range having the alpha-beta transition temperature as its upper limitation and a temperature 100° below the alpha-beta transition temperature as its lower limitation. Current density is maintained at between about 5 and 25 millamperes per square centimeter.

The method of the instant invention finds particular application in fabrication of electrodes, particularly anodes, for use in electrolytic cells for the production of a halogen. Such an electrode comprises an electrically conductive substrate having a valve metal coating electrodeposited thereon. The electrode includes a zone between the coating and the substrate having one or more interdiffused phases of the coating valve metal and the substrate. Portions of the coating further removed from the substrate remain substantially free of the substrate metal. The coating is not more than 10 mils in thickness. An electrocatalyst is applied to at least a portion of surfaces of the electrode.

The coating on these electrodes is comprised of relatively large grains of the valve metal. In a particularly preferred embodiment, the substrate is copper and the valve metal is titanium. Large grain electrodeposits contribute to effective protection for the copper by the valve metal in the environment of an electrlolytic halogen generation cell.

The above and other features and advantages of the invention will become more apparent when considered with the description of the best embodiment of the invention and the drawings that follow.

BEST EMBODIMENT OF THE INVENTION

Figure 1:
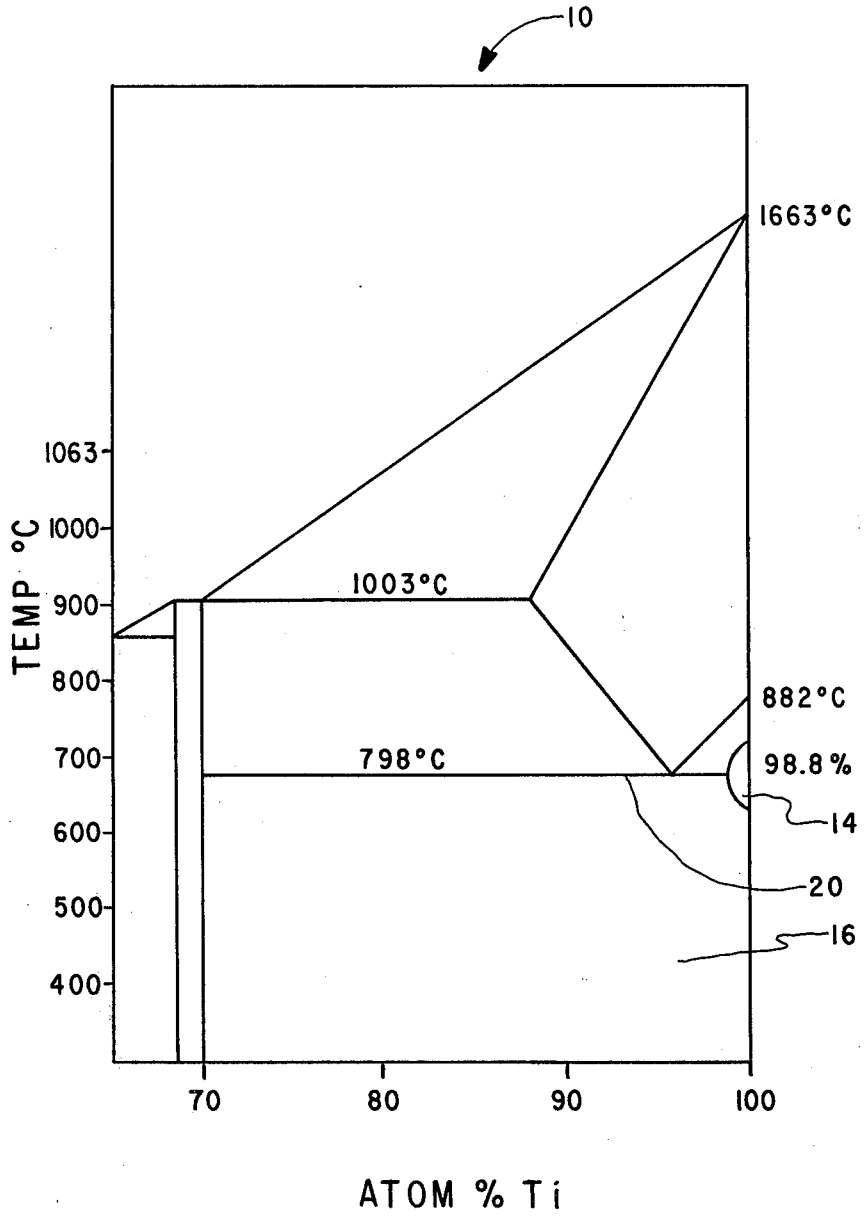
FIG. 1 is a portion of a binary phase diagram for solid solutions of a titanium valve metal and copper showing portions relating to phases formed with copper as the solute and titanium as the solvent.

In the present invention, an electrodeposited valve metal coating or cladding is applied to a conductive substrate. By careful control of electrodeposition conditions, the resulting clad structure includes a core of substrate metal substantially free of contamination by the coating valve metal, a coating portion substantially free of contamination by the substrate metal, and a zone between the uncontaminated metals that includes one or more interdiffused phases of the two metals. In this best embodiment, the present invention finds particular utility in the fabrication of electrodes for use in electrolytic cells such as cells for the electrolytic generation of halogens like chlorine.

Valve metals have found substantial acceptance in, particularly, the chloralkali industry. These valve metals, or so-called passivating metals, include titanium, zirconium, bismuth, niobium, aluminum, tantalum, tungsten and their mixtures. Particularly titanium, partly for cost and relative ease of fabricationreasons and partly for stability reasons, has found broad acceptance as a suitable material for constructing chloralkali electrolytic cell electrodes and particularly for cell anodes.

In the cell environment, a titanium anode quickly passivates, forming a protective film that substantially resists corrosive effects of contents of the chloralkali cell. This passivation also effectively terminates any significant electrolytic activity at the anode by reason of this passive layer being substantially nonelectrically conductive.

Coating of a titanium electrode with an electrocatalyst can maintain electrical activity of the electrode while capitalizing upon the corrosion resistivity of the titanium electrode structure. A variety of electrocatalyst formulations may be utilized effectively in a chloralkali cell. Typically the catalyst is a platinum group metal, ruthenium, rhodium, iridium, palladium, osmium, or platinum; gold or silver; or an oxide of a platinum group metal; or a mixture of the foregoing. With some of the electrocatalysts, it has been found beneficial to include oxides of other metals such as antimony, tin, valve metals and manganese mixed either with the electrocatalyst or applied separately as a top coating.

Preparation and application of these electrocatalysts is now well known in the art; and for purposes of implementing this instant invention, any suitable or conventional electrocatalyst and method of application may be used in preparing an electrode made in accordance with the invention. Certain of the electrocatalytic compounds, particularly the metal oxides are applied by placing a precursor compound of the metal upon the electrode and then heating the electrode to convert the precursor compound of the metal to an oxide of the metal. For example, rhuthenium chloride and rhodium chloride dissolved in an alcohol and painted upon a titanium electrode, heated at about 525° C. for 5 to 15 minutes are converted to ruthenium oxide and rhodium oxide.

In implementing the instant invention, where temperatures used in applying electrocatalyst are about 450° C. or greater, care is required to assure that the heating temperature does not exceed the alpha-beta transition temperature for the particular substrate metal and valve metal pair from which the electrode has been fabricated. Typical substrates suitable for use in implementing the invention include nickel, copper, iron, gold, platinum and silver. For coatings of titanium on these metals, the alpha-beta transition temperature is generally sufficiently elevated to permit application of desired electrocatalysts without exceeding the transition temperature.

In making an electrode according to the instant invention, a valve metal coating is electrodeposited upon a conductive substrate. For reasons related to cost, availability and electrical conductivity, of the group silver, gold, platinum, copper, iron and nickel, copper is much preferred. Nickel and iron, relating to the same factors are somewhat less preferable, with gold, silver, and platinum being yet less preferable primarily as a result of cost considerations. Except for minor electrical conductivity disadvantages to iron and nickel substrates, particularly titanium coated electrodes fabricated according to the instant invention using these substrates and coated with an electrocatalyst provide desirable electrode characteristics in an electrolytic cell.

In practicing the instant invention, a substrate, in this best embodiment a copper substrate, is immersed in a fused salt electrolysis bath containing the valve metal to be electrodeposited upon the substrate. The substrate is made cathodic within the bath whereupon the valve metal, in this best embodiment titanium, electrodeposits upon the substrate to form a coating of the valve metal upon the substrate. The resulting coating should be a dense, impurity-free coating relatively uniform in thickness and substantially free of voids.

Impurities, it has been found, can arise in electrodeposition of titanium where water and/or oxygen are present. Particularly the presence of hydronium ions adjacent sites of titanium electrodeposition can be dysfunctional to achieving a desired titanium coating. In part for that reason, substrates electrodeposited with titanium from an aqueous electrolysis bath have generally produced less than a desirable coated electrode.

Valve metal coated conductive substrate electrodes can be subject to temperature fluctuations, particularly where heating is required for application of electrocatalysts. During these temperature fluctuations, differences in thermal expansion characteristics between the coating and the substrate can cause buckling and/or cracking resulting in early electrode failure. It is therefore desirable that the titanium coating be at least partially interdiffused with the substrate and thereby relatively more firmly attached to the substrate.

Any interdiffusion between the substrate and the coating can be in the form of a solid solution or an intermetallic compound. A solid solution is a homogenous crystalline phase composed of at least two distinct chemical species occupying lattice or interlattice points within a crystalline structure at random. These solutions, for a given species pair, can exist in a range of species concentration. Intermetallic compounds, also known by the terms Hume-Rothery or electron compounds, are alloys of usually two metals wherein a progressive change in composition of the alloy is accompanied by a progression of phases, each phase, generally differing in crystalline structure. For the valve metals and substrates preferred for use in the instant invention, substantial interdiffusion generally occurs, absent a significant pressure applied to the two metals when closely adjacent, only at elevated temperatures, particularly those in excess of about 454° C.

It has been found that a particularly desirable electrodeposition of a valve metal on a conductive substrate for use as an electrode can be obtained by electrodeposition in a fused salt electrolysis bath.

The salts generally preferred for use in the practice of the instant invention are halide salts of Periodic Table Group I and II metals. The Group I or alkali metals are lithium, sodium and potassium, preferred in the practice of this invention, and rubidium, cesium, and francium. The Group II or alkaline earth metals are magnesium, calcium, strontium and barium, generally preferred in practicing the instant invention, and radium. Beryllium salts are generally not as suitable for use in an electrolysis bath for the practice of the instant invention.

Any halide, fluorine, chlorine, bromine or iodine can be used in the electrolysis bath salts for practicing the instant invention. Fluorine and, to a lesser extent, chlorine are much preferred in practicing the instant invention as they provide a fluxing action during deposition of metals in the electrolysis bath. Mixtures of the alkali and alkaline earth metal halide salts will produce satisfactory results in the practice of the instant invention.

The fused salt or molten electrolyte should also contain the valve metal being electrodeposited. The valve metal can be present in any quantity from a trace amount to saturation of the fused salt electrolyte with the valve metal being deposited. It is preferred, however, that valve metal being electrodeposited be present in the fused salt electrolyte in a concentration of between about 5 and 15 weight percent. The concentration preferred varies within this range partly as a function of the valve metal being electrodeposited and the other salts present in the fused salt electrolyte.

The nature of the fused electrolysis bath to some extent also determines the lower operating temperature available for carrying out the instant invention. Some halide salt mixtures such as flinak, a eutectic mixture of lithium, potassium, and sodium fluoride salts and much preferred as the fused salt electrolyte in the practice of the instant invention, become molten at a temperature as low as 454° C., while others remain crystalline until reaching a considerably more elevated temperature. Some operational parameters of the instant invention, such as the electrical conductivity of the substrate and the rate of interdiffusion between the coating valve metal and the conductive substrate, often depend in part upon the temperature at which the process of the instant invention is operated. Selection of a suitable operational electrolysis bath temperature is, therefore, of some import. Where coating copper or nickel with titanium, preferably, the electrolysis bath is maintained at a temperature of at least 700° C., but in no event should exceed the alpha-beta transition temperature for the coating and substrate.

In a fused salt electrolyte such as flinak, the presence of sufficient water in the bath to present a hydronium ion difficulty at the site of titanium electrodeposition is remote, as a result of the elevated bath temperature required to melt the salts. While the bath may initially include other impurities that may interfere with achieving a desired dense, generally uniform and impurity-free coating of the valve metal upon the substrate, these impurities may be removed by electrodeposition from the bath until desired characteristics of the electrodeposit are achieved.

One significant impurity, oxygen, may be substantially excluded from a bath made impurity free by performance of electrolysis under an inerted atmosphere. Argon, helium, and in some cases nitrogen are suitable for inerting. It may be desirable to treat inerting gases to remove residual oxygen prior to introducing the gas into an apparatus used for electrodeposition.

In the preferred embodiment, inert gas is introduced subsurface to the fused salt electrolyte. Subsurface introduction promotes turbulent mixing within the fused salt electrolyte, valuable where concentration gradients may become established, for example, during current density operation. Subsurface introduction of the inert gas serves also to assist in stripping such compounds as HF from the fused salt electrolyte.

Figure 2:
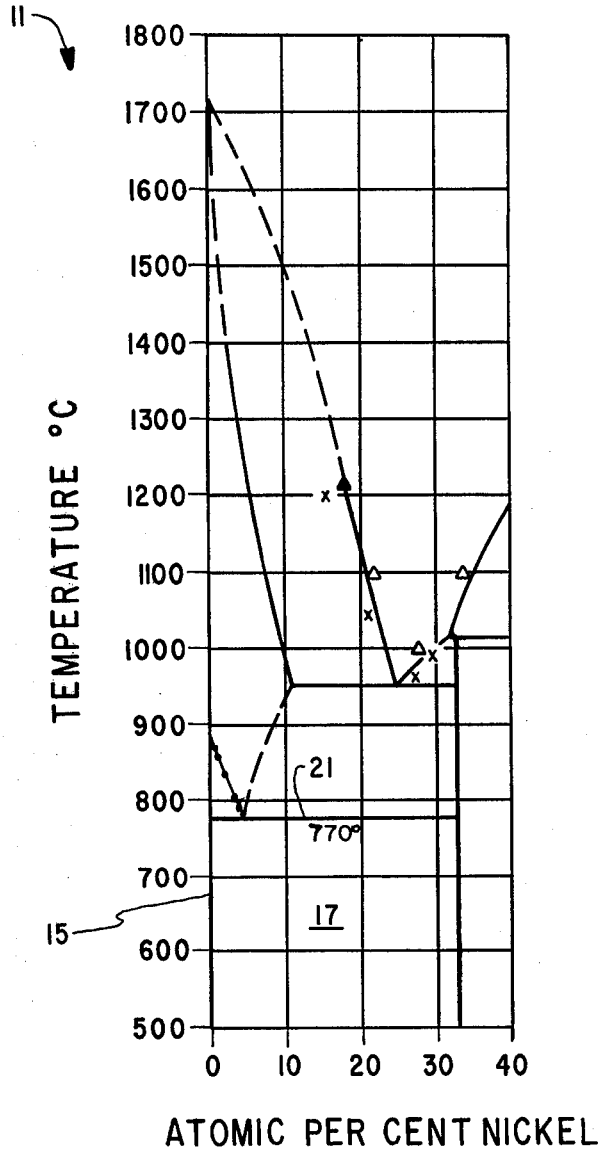
FIG. 2 is a portion of a binary phase diagram similar to FIG. 1 but for titanium and nickel.

Referring to the drawings, FIGS. 1 and 2 represent portions of phase diagrams 10, 11 for binary solid solutions and interdiffused compounds of metals, FIG. 1 is concerned with interdiffused compounds of copper and titanium while FIG. 2 concerned with interdiffused compounds of nickel and titanium. The phase diagram portions 10, 11 each depict solutions tending to be relatively rich in the valve metal titanium, that is solutions wherein the titanium functions as a solute for the conductive copper or nickel. Concentration as atom percentage is plotted along the axis while temperature is plotted on the abcissa.

On each diagram, it may be seen that there is a zone 14, 15 wherein titanium exists in the alpha crystalline state. For copper titanium interdiffused metals, this alpha zone 14 accomodates a low percentage of copper in a true solid solution of the two metals. Additional copper produces a solid solution between $CuTi_2$ and alpha titanium characterized by a zone 16. For nickel, the alpha titanium does not support a significant solid solution of nickel. Instead even a small quantity of nickel produces a solid solution of $Ti_2Ni$ in the alpha titanium represented by a zone 17.

On each of the diagrams 10, 11, there is a minimum alpha-beta transition temperature line 20, 21. This alpha-beta transition represents the temperature at which a binary metal system undergoes transition from alpha to beta crystal form and is more properly termed the eutectoid transistion temperature for alpha-beta transition in a binary metal system. The phase eutectoid transition temperature alpha-beta transition temperature are used interchangeably hereinafter. This line represents the temperature at which titanium crystal structure transforms from a more closely packed crystalline structure to a less dense crystalline structure. In applying coatings to, particularly electrodes, it is much preferred that the titanium be applied to the substrate in the more dense state, as growth of large crystals is facilitated, and stains and stresses between the titanium coating and the copper or nickel substrate are reduced as the electrode cools following electrodeposition. Such stresses and strains can cause buckling or cracking of the coating exposing the substrate to possible corrosive attack when the electrode is placed in an electrolytic environment. It is therefore of substantial importance in the practice of this invention that the bulk of and preferably all electrodeposition be conducted below this minumum alpha-beta transition temperature.

For other metal pairs of a valve metal and a conductive substrate, generally a similar temperature line will serve to define a transition between a more closely packed valve metal crystalline structure and a less closely packed valve metal crystalline structure. For convenience, this transition temperature for binary metal pairs of valve metals and the conductive substrates is referred to as the alpha-beta transition temperature. In implementing the instant invention, it is much preferred that the temperature of the fused salt bath be kept below this transition temperature throughout electrodeposition.

Typical eutectoid or alpha-beta transition temperatures for a number of valve metal coating applications to substrates are summarized in Table I.

TABLE I

| | |
|---|---|
| titanium-iron | 590° C. |
| titanium-copper | 798° C. |
| titanium-nickel | 770° C. |
| titanium-silver | 855° C. |
| zirconium-copper | 882° C. |
| zirconium-iron | approx. 795° C. |
| zirconium-nickel | 808° C. |
| zirconium platinum | 826° C. |
| titanium-platinum | 840° C. |
| titanium-gold | 833° C. |

Certain of the valve metals and substrates such as mixtures of gold, copper or silver with tungsten do not appear sufficiently miscible to permit implementing the instant invention. Others like bismuth-platinum, zirconium-gold and bismuth-nickel are possessed of an alpha-beta transition temperature insufficiently elevated to permit ready electrodeposition from a fused salt electrolysis bath without a strong likelihood or a certainty of exceeding the transition temperature.

In applying the valve metal to the conductive substrate by electrodeposition techniques, it is desirable that the resulting electrode coating has a surface substantially free of the substrate metal. This relatively pure surface can be accomplished by electrodepositing the valve metal somewhat more rapidly then into diffusion between the valve metal and the substrate occurs. An electrode results having a relatively pure substrate metal core, a relatively pure valve metal coating or cladding and a layer between the two of at least one substantially interdiffused phase of the two metals.

Figure 3:
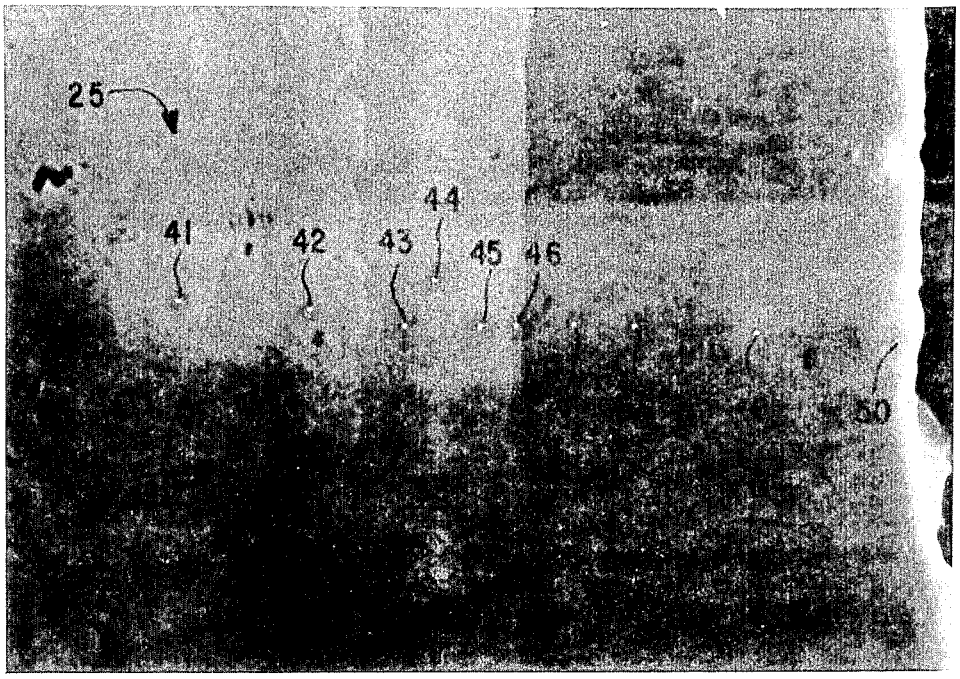
FIG. 3 is a photograph of an electron microscope scan (2000×) of a cross-section of an electrode made in accordance with the instant invention.

Referring to FIG. 3, an electron microscope view of a cross-section of a typical electrode 25 is shown having a copper core 30, a relatively pure titanium coating 31 and zones 32, 33, 34 of interdiffusion between the relatively pure metals. Reference numerals 41 through 50 indicate positions from within the electrode 25 from which material was taken for analysis. Table II summarizes results expressed in percent (wt./atomic) for the locations within the electrode represented by the reference numerals.

TABLE II

| Reference Numeral | Percentage Copper |
|---|---|
| 41 | 93 |
| 42 | 74 |
| 43 | 47 |
| 44 | 45 |
| 45 | 46 |
| 46 | 28 |
| 47 | 2 |
| 48 | 2 |
| 49 | 1 |
| 50 | 1 |

The rate of interdiffusion between the metals is at least partly dependent upon the temperature of the metals. One tool available for maintaining a desired ratio between the rate of interdiffusion between the metals and the rate of electrodeposition of the valve metal for providing a substantially pure valve metal coating is control of the temperature of the fused salt electrolysis bath. At lower temperatures, the rate of interdiffusion of a metal pair can decrease markedly while the rate of electrodeposition from the bath remains relatively unchanged, at least while the bath remains molten. While operation at temperatures nearly as low as the melting point of the fused salt electrolyte is feasible for most metal pairs, electrodeposition between the alpha-beta transition temperature and a temperature about 100° C. below the eutectoid transition temperature is preferred with the much preferred operation being within about 50° C. of the alpha-beta transition temperature.

Electrodeposition from the fused salt electrolysis bath is constrained generally to a current density measured at the substrate being coated of 100 milliamperes per square centimeter or less. At a more elevated current density, the electrodeposited valve metal generally lacks the uniformity and large crystal grain sizing necessary for effecting a desired long-lived electrode coating. Typically electrodeposition is conducted at between about 5 and 25 milliamperes per square centimeter; the actual current density can be varied to assist in providing an electrodeposition rate desirably greater than the rate of interdiffusion between the substrate and coating metals.

In some applications, the coating valve metal may tend to develop dendrites or other surface irregularities in coating the substrate. In this best embodiment, these irregularities are controlled by periodically reversing polarity in the electrodeposition cell, making the substrate temporarily anodic. Reversal is preferably accomplished at a current density substantially greater than the current being used for electrodeposition. Reversal is preferably continued only briefly, for example 15 minutes, during a 2-hour electrodeposition cycle.

Introduction of the valve metal into the fused salt electrolyte is accomplished in any suitable or conventional manner. A halogen salt of the valve metal can be introduced, quantities of ground state valve metal can be introduced, or the anode used to form an anode cathode pair with the conductive substrate can be formed at least in part from the valve metal. The vessel in which electrodeposition is conducted can be made from the valve metal and, optionally, can function as a cell anode.

Where fused salt electrolyte is prepared external to the electrodeposition cell, treatment by preliminary electrolysis or the like is generally required to remove impurities prior to use in the cell. The fused salt is preferably stored in an inerted atmosphere to forstall reintroduction of, particularly, oxygen related contaminants.

For some valve metals, such as titanium, the valence of ions of the titanium at the point of electrodeposition from the fused salt electrolysis bath can, to a substantial extent, determine the quality of the valve metal coating achieved upon the conductive substrate. Particularly for titanium, the valence of ions being electrodeposited should be $Ti^{+3}$. Where $Ti^{+4}$ ions electrodeposit in substantial quantity, the resulting coating can form a crust substantially dysfunctional to obtaining a desired valve metal coating.

In a typical flinak electrolysis bath, a satisfactory proportion of $Ti^{+3}$ can generally be obtained where a ground state titanium is present in the electrodeposition. It is believed that a reaction occurs whereby $Ti^0 + 3Ti^{+4} \rightleftarrows 4Ti^{+3}$. Since generally the quantity of $Ti^{+4}$ present in a typical electrolysis bath is small, the quantity of $Ti^0$ introduced into the bath can be correspondingly small.

A competing reaction, $Ti^0 + 3K^+ \rightleftarrows Ti^{+3} + 3K^0$, can, under certain circumstances where $K^0$ can escape the electrolysis bath, quickly exhaust an electrolysis bath of $Ti^0$. Exhaustion can occur, for example, by vaporization of K from the bath and subsequent crystallization of the K in vapor spaces of the electrodeposition cell. This phenomenon can be suppressed by the exercise of caution in insulating the vapor spaces of the electrolytic cell and in suitably preheating inerting gases fed to the vapor spaces.

It is preferable that cell materials of construction be not readily corroded by fluoride melts, and that the metal(s) selected for cell constructions be more electronegative (less active) that the valve metal being electrodeposited so as to not displace valve metal solute from the electrolysis bath. The electrolysis cell can be fabricated from a variety of suitable and conventional materials including titanium, graphite, Inconel® 600 and Monel® proprietary nickel alloys marketed by International Nickel Co., nickel and molybdenum. Stainless steels, while less desirable, are also useful.

Anodes, where not made of the valve metal being electrodeposited, may be made from graphite or other suitable anode materials. Materials used in fabricating electrolysis cells for the practice of the instant invention generally should be resistant to the elevated temperatures associated with fused salt systems as well as resistant to corrosive and solvating effects of fused salt baths.

One important consideration in preparing electrodes in accordance with the present invention is assuring substantial adhesion to the substrate. In the corrosive environment of a chloralkali cell, even slight spalling or cracking of the titanium cladding on a copper electrode substrate can substantially shorten the expected lifetime of the electrode. One large stress that can damage the integrity of a valve metal cladding on a substrate is associated with cooling of the electrode following electrodeposition of the valve metal. Since the chances of thermal expansion coefficients for both the substrate and coating metals being substantially equal is remote, substantial stresses can develop between the substrate and coating metals while cooling. The opportunity for developing one or more coating stress reliefs that would make the electrode unsuitable for use in a chloralkali cell, for example, can be enhanced by application of an electrocatalyst to the cooled, coated substrate. An example would be where an electrocatalyst precursor is applied requiring substantial heating for conversion to the electrocatalyst. Since several such applications are generally required necessitating several cycles of heating and cooling to a temperature as great as 550° C., the opportunity for stress damage to the electrode is enhanced.

Interdiffusion between the coating and the substrate metals strengthens the bond between coating and substrate beyond whatever strength is derived from simple application of the coating metal to the substrate surface. In addition, the coating of the instant invention is made relatively thin, preferably not thicker than 10 mils, or thousandths of an inch including interdiffused zones. Adhesion associated with the interdiffused metals is therefore relatively strong in comparison to forces generated during straining or stressing of the coating related to heating or cooling. In this best embodiment, the coating or cladding is between about 2 mils and 8 mils, titanium on copper. The interdiffused zone 32 can be nearly as thick as the coating but typically varies from 1 to 5 mils depending upon the metals selected for the substrate and the cladding. The entire thickness of relatively pure coating metal and interdiffused zones generally should not exceed about 10 mils.

Where crystals of a deposited valve metal intersect in making a coating, a port can remain giving access to the substrate by contents of an electrolysis cell in which the electrode might find later used. Such access, where the contents are corrosive, can lead to rapid spalling of the valve metal coating and a consequential early electrode failure.

Figure 4:
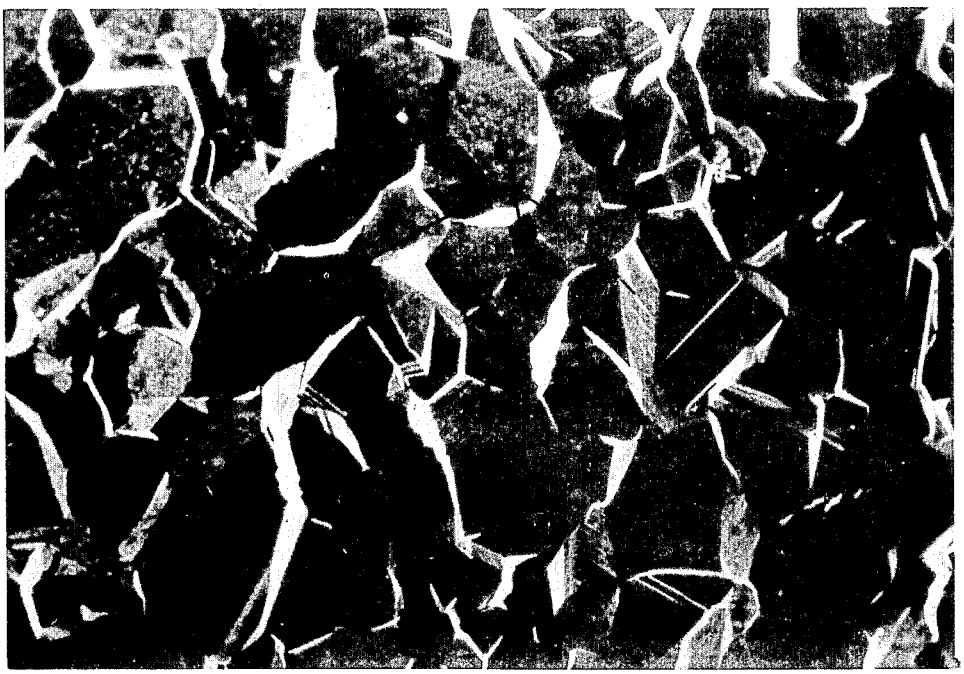
FIG. 4 is an electron microscope scan photograph (200×) of surface grain configuration of an electrode coated in accordance with the instant invention.

A coating having relatively large grains of the coating metal desirably reduces intersections per unit area of the coating thereby decreasing the opportunity for pore formation. A scanning electron micrograph of a typical coating 60 resulting from application of the method of the instant invention is shown in FIG. 4 magnified 200 times. The grains 62 are to some extent a result of nucleation of crystals forming by electrodeposition.

One factor strongly influencing crystal size is the rate at which coating metal is electrodeposited. A rapid electrodeposition rate tends to form relatively smaller crystals tending to nucleate into smaller grains. Another less important factor is the crystalline state in which the coating valve metal deposits. For large crystals in the instant invention, it is generally desirable that the metal be deposited in the alpha crystal state or more closely packed crystal state. Still another factor is current reversal. Control of surface irregularities such as dendrites tends to produce a more uniform coating having, it is believed, more desirable nucleation characteristics. Grain size in a coated electrode produced according to this preferred embodiment typically lies in a range of between 25 microns and 200 microns.

The following examples are offered to further illustrate the invention.

EXAMPLE 1

A titanium crucible was prepared from a 12 inch length of $3\frac{1}{2}$ inch diameter schedule 40 titanium pipe having a $\frac{1}{4}$ inch titanium flat bottom welded to it. The titanium crucible was filled with 1000 grams of a ternary eutectic mixture of sodium, potassium, and lithium fluorides (flinak) containing 80 grams of titanium (III) fluoride, and 20 grams of sodium bifluoride. The crucible with its contents was placed in an INCONEL chamber equipped with a stainless steel top and stainless steel fittings. The chamber was purged using helium gas at a rate of approximately 150 cubic centimeters per minute. During the initial purge, the chamber was maintained at 250° C. for 51 hours. Under continuing purge, the chamber was then heated to melt the salts.

Sacrificial electrolysis was conducted to remove impurities from the fused salt electrolysis bath. Sacrificial electrolysis was accomplished by placing a consumable titanium anode in the crucible, immersed in the fused salts, and passing a current of 8.4 ampere hours between the consumable titanium anode and a sacrificial copper cathode also immersed in the fused salt electrolyte. The cathode was sized such that current densities at the surface of the copper cathode were maintained in a range of 5 to 21 milliamperes per square centimeter. The anode surface area was maintained to be 3 to 4 times the cathode.

Following removal of impurities from the fused salt electrolysis bath, a $\frac{3}{4}$ inch × 2 inch × 0.065 inch copper cathode substrate was immersed in the fused salt electrolysis bath for 960 minutes at a cathodic current density of approximately 5.2 milliamperes per square centimeter. Electrodeposition was conducted at 740° C. The copper substrate had been prepared by welding a copper wire current feeder to the $\frac{3}{4}$ inch × 2 inch × 0.065 inch copper substrate. A crystalline titanium deposit with relatively small dendrites was obtained on the copper during the run.

Copper samples used in electrodeposition in the instant example were cleaned at room temperature prior to the plating runs. Generally a two-bath preparation system was used. The first bath comprised generally a 3 to 5 minute immersion in a solution of 28 grams of sodium dichromate and 120 milliters of sulfuric acid added to one quart of distilled water. The substrates were then rinsed at least once in a distilled water bath and air dried. An air lock, accommodating the $\frac{1}{8}$ inch copper wire current feeder, was utilized for introduction of the copper cathodes into the titanium crucible via the INCONEL chamber.

Following completion of an electrolysis run, the coated cathode was removed from the titanium crucible. Residual fluoride salts from the bath were removed by ultrasonic cleaning in dilute sulfuric acid and by water rinsing. The titanium plated copper sample obtained was immersed over $\frac{3}{4}$ of its length into a sodium chloride saturated brine at room temperature having a pH of 2.0. The coated copper substrate was opposed by a titanium rod electrode spaced $\frac{1}{4}$ inch from one surface of the coated copper.

The coated copper strip immersed in the saturated brine was made anodic to the titanium rod electrode, the brine being maintained at about 30° C. in a stirred condition. The coated copper strip was maintained under electrical potential for 3 months after which no observable corrosion of the titanium coated copper substrate was observed. During maintenance under electrical potential, an anodic current density of 1.5 microamperes per square centimeter was maintained.

EXAMPLE 2

A titanium coated copper substrate was prepared in a manner according to Example 1 except that electrodeposition was conducted at a temperature of 770° C. for 990 minutes at a current density of 5.7 milliamperes per square centimeter. The coated copper substrate was tested as an anode in saturated brine in a manner similar to that of Example 1 at an applied voltage of 1.5 volts. The substrate was maintained under electrical potential for 137 days at an anodic current density at the titanium coated copper substrate during the final days of polarization of 15 microamperes per square centimeter. No coating porosity or its consequences was observed.

EXAMPLE 3

A titanium coated copper substrate was prepared according to the manner of Example 1 except that electrolysis was conducted at 770° C. for 930 minutes at a current density of 12.9 milliamperes per square centimeter. Periodically during electrodeposition, the polarity of the copper substrate being titanium electrocoated was reversed at a current of 2.6 milliamperes per square centimeter for a duration of 0.1 second. The resulting titanium coated copper substrate included a particularly smooth, crystalline, dendrite free deposit.

The titanium coated substrate was made anodic in saturated brine in the manner according to Example 1. After 66 days, the coated copper substrate showed no signs of titanium coating discontinuity.

EXAMPLE 4

A titanium crucible was prepared in the manner of Example 1, and charged with 110 grams of titanium (III) fluoride 591 grams of potassium fluoride, 292 grams of lithium fluoride, 117 grams of sodium fluoride and 20 grams of sodium bifluoride. The charged crucible was heated under a subsurface flow of helium gas for 88 hours at 250° C. The salts were then slowly melted.

A soluble titanium anode was immersed into the melted or fused salts contained within the crucible. A $\frac{3}{4}$ inch × 2 inch × 0.065 inch sacrificial cathode was immersed in the fused salts and made cathodic to the soluble titanium anode. Approximately 8 ampere hours of current was passed between the anode and sacrificial cathode to remove impurities from the fused salt baths.

A $\frac{3}{4}$ inch × 2 inch × 0.065 inch copper substrate, cleaned in a solution of sulfuric acid and sodium dichromate, was subjected to titanium electrodeposition in the fused salt electrolyte contained within the crucible for 930 minutes at a current density of 5.9 milliamperes per square centimeter of copper substrate surface at a temperature of 750° C. The resulting coating was rough and exhibited small dendrites.

EXAMPLE 5

A titanium clad copper substrate was prepared in a manner in accordance with Example 1 except at 770° C. for 960 minutes at 5.7 milliamperes per square centimeter.

EXAMPLE 6

The titanium clad copper substrates manufactured in Examples 4 and 5 were each coated with a mixture of titanium and ruthenium oxides. These substrates with their metal oxide coatings were immersed in a concentrated sodium chloride brine having a pH of approximately 2.5 and made anodic. Chlorine gas was evolved from these anodic noble metal oxide coated substrates.

Metal oxide coatings were applied to the substrate by painting the substrate with an acidic solution of titanium and ruthenium chlorides. The painted solution was allowed to dry on the substrate and then baked for 10 minutes at a temperature of approximately 525° C. in an oxygen containing environment. Painting, drying, and baking cycles were repeated 10 times for each substrate after which the substrates were baked for 20 minutes at 525° C. in an oxygen containing environment.

EXAMPLE 7

A sealed cell-crucible was constructed from a length of 4 inch schedule 40 INCONEL pipe having a $\frac{1}{4}$ inch thick flat bottom. The INCONEL crucible was charged with 533 grams of a eutectic mixture of sodium, potassium, and lithium chlorides containing 7 weight percent of titanium (III) fluoride, and 2 weight percent sodium bifluoride. Heated to 250° C., the salts contained in the crucible were dried under a flow of helium gas for 72 hours. The salts were then melted to provide a fused salt electrolysis bath.

The fused salt electrolysis bath was purged of impurities by electrodeposition of titanium from a consumable titanium anode placed in the INCONEL crucible upon sacrificial 1 inch × $\frac{3}{4}$ inch × 0.065 inch copper substrates. 22 grams of titanium metal was then added into the fused salt electrolysis bath.

A 1 inch × $\frac{3}{4}$ inch × 0.065 inch copper substrate was then electroclad with titanium at approximately 770° C. for 930 minutes at 9.3 milliamperes per square centimeter. Periodic current reversal was conducted to control dendrite formation, pulses being of 0.1 second duration and of 41.3 milliamperes per square centimeter current density measured at the copper substrate. Reversals were accomplished every 1.0 second.

The plated copper substrate resulting from the electrocladding operation was removed from the fused salt electrolysis bath, cleaned of residual salts in the manner according to Example 1, and was immersed in a solution of hydrochloric acid having a pH of 2, and saturated with sodium chloride at room temperature. While immersed in the resulting acidic brine, the clad copper substrate was made anodic to a titanium cathode at 1.5 volts. After 11 days, the titanium clad copper substrates showed no signs of porosity through the titanium cladding.

EXAMPLE 8

A titanium crucible was prepared in accordance with Example 1. The crucible was charged with 980 grams of a eutectic of sodium, potassium, and lithium fluorides, 110 grams of titanium (III) fluoride, and 20 grams of sodium bifluoride. Under an inert gas flow, the salts contained within the crucible were dried for 72 hours at 250° C. The salts were then gradually melted over a period of 4 hours to provide a fused salt electrolyte bath.

The fused salt bath was purged of impurities by making the titanium crucible anodic to a 1 inch × $\frac{3}{4}$ inch × 0.065 inch copper substrate immersed in the fused salt electrolyte. 1.6 ampere hours were passed between the immersed copper substrate and the titanium crucible at a current density of 20.7 milliamperes per square centimeter measured at the copper substrate. An additional 1.6 ampere hours were passed between the immersed copper substrate and the titanium crucible at a current density of 5.7 milliamperes per square centimeter.

A 2 inch × $\frac{3}{4}$ inch × 0.065 inch copper electrodeposition substrate was immersed in the fused salt electrolyte bath at 770° C. for 60 minutes. 20.7 milliamperes per square centimeter was passed between the immersed electrodeposition substrate and the titanium crucible. A titanium cladding resulted upon the immersed electrodeposition copper substrate.

EXAMPLE 9

A fused salt electrolyte bath was prepared in a manner identical to that of Example 8 except that a 990 grams of the eutectic salt were utilized, and drying was accomplished at 200° C. for 41 hours and then at 250° C. for 27 hours.

The resulting fused salt electrolyte bath was purged in impurities by passing 1.6 ampere hours at 20.7 milliamperes per square centimeter measured at a sacrificial copper substrate immersed in the fused salt electrolyte between the sacrificial copper substrate and the titanium crucible.

A 2 inch × $\frac{3}{4}$ inch × 0.065 inch copper electrodeposition substrate was then electroclad with titanium by passing an electric current between the electrodeposition copper substrate and the titanium crucible for 60 minutes at 20.7 milliamperes per square centimeter measured at the electrodeposition copper substrate. A titanium cladding resulted upon the substrate.

EXAMPLE 10

The electrolysis bath of Example 9, following the completion of electrolysis outlined in Example 9, was subjected to an additional purging electrolysis run during which 1.6 ampere hours was passed between the sacrificial copper cathode and the titanium crucible at a current density of 5.7 milliamperes per square centimeter as measured at the sacrificial copper cathode.

An electrodeposition copper substrate measuring 2 inch × ¾ inch × 0.065 inch was then immersed in the fused salt electrolyte and made cathodic to the titanium crucible. Electrolysis was conducted for 60 minutes at 20.7 milliamperes per square centimeter to produce a titanium cladding upon this electrodeposition copper substrate.

EXAMPLE 11

The titanium clad copper substrates produced in Examples 8, 9 and 10 were coated with an electrocatalytic metal oxide mixture. Coating was accomplished by painting an acidic chloride solution of ruthenium and titanium chloride salts on the substrate and by drying and then heating the substrates at a temperature of approximately 525° C. for between 5 and 10 minutes. Seven such coatings were placed on each of the three substrates.

The 3 substrates were then installed as test anodes in 150 gram per liter sulfuric acid at 50° C. The test anodes were operated at 5 amperes per square inch and at a current density so that oxygen was evolved from the sulfuric acid solution. A constant current density of 5 amperes per square inch was maintained throughout lifetime testing of these anodes, and the test was terminated when the voltage required to maintain the 5 amperes current density reached 1.2 times the steady state voltage for the anodes when installed.

Before testing began, the prepared anodes were subjected to nondestructive testing for ruthenium concentration, with initial values being approximately 7 ¼ grams per square meter. After testing was discontinued, substantial declines in ruthenium content were noted. Testing was discontinued for the titanium clad copper substrate prepared in Example 8 after 8 hours. Testing was discontinued for the titanium clad copper substrate prepared in Example 9 after 11 hours, and testing was discontinued for the titanium cald copper substrate in Example 10 after 8 hours.

Three solid titanium control samples similar in size to the titanium clad copper substrates and simultaneously prepared including electrocatalytic coatings showed cell lifetimes of 9 ½, 10 and 8 ⅓ hours. Initial ruthenium concentrations on these solid titanium controls were 7 grams per meter squared.

EXAMPLE 12

A nickel cathode substrate was prepared by pickling in a solution of hydrofluoric and nitric acids and subsequent air drying.

640 grams of potassium hexaflurotitanate, 675 grams of sodium fluoride, 1758 grams of lithium fluoride and 3162 grams of potassium fluoride were blended. 1189 grams of this blend and 18 grams of silver bifluoride were combined and placed into a 12 inch tall titanium crucible fabricated from 3 inch schedule 10 titanium pipe having a ¼ inch flat bottom. The crucible and salt contents were heated in an inerted atmosphere for 72 hours at 250° C.

Contents of the crucible were then melted by elevating the temperature and the titanium crucible was made anodic to a sacrificial nickel substrate immersed in the resulting fused salt electrolyte. 5 ampere hours of current was passed between the sacrificial nickel substrate and the titanium crucible to remove impurities from the fused salt electrolyte. Impurity removal was conducted in a current density range measured at the immersed sacrificial nickel substrate of 3 to 8 milliamperes per square centimeter. The final 0.13 ampere hours of impurity removing electrolysis was done under a current density of 40 milliamperes per square centimeter.

A 1 inch×3 inch×0.065 nickel electrodeposition substrate was then immersed in the fused salt electrolyte. With the fused salt electrolyte maintaned at 736° C., a 13 milliampere per square centimeter electrical current was utilized to electrodeposit titanium onto the electrodeposition nickel substrate for 41 minutes. Current density was measured at the immersed nickel substrate. A crystalline titanium deposit was obtained on the nickel substrate.

The resulting titanium clad nickel substrate was removed from the fused salt electrolyte, cleaned in hot water and then subjected to coating with an electrocatalytic substance. Electrocatalyst was applied to the titanium clad nickel substrate by 10 sequential applications of an acidic solution of tin and ruthenium chlorides. After each application, the substrate was dried in air and then heated in air to a temperature of approximately 525° C. Additional coatings were applied only after the titanium clad nickel substrates had cooled to room temperature. Heating at 525° C. was accomplished for between 5 and 10 minutes, except after the last coating where the heating period was 15 to 20 minutes.

The titanium clad nickel substrate was then immersed in 150 gram per liter sulfuric acid at 50° C. The titanium clad nickel substrate was made anodic at an anodic current density of 300 milliamperes per square centimeter for 5 hours and then at 750 milliamperes per square centimeter for in excess of 17 hours. Vigorous oxygen evolution occurred. Subsequent micrographic analysis indicated excellent retention of the ruthenium and tin oxide coatings, and the existance of a substantially nonporous titanium deposit upon the nickel.

EXAMPLE 13

975 grams of a eutectic mixture of sodium, potassium, lithium fluorides are mixed with 20 grams of sodium bifluoride and 150 grams of potassium hexafluorozirconate ($K_2ZrF_6$). These mixed salts are placed in a graphite crucible 3.7 inches in diameter by 10 inches in height with a 0.2 inch wall thickness. The salts are heated under an inert gas flow for 72 hours of 250° C. and then heated to 800° C. gradually over a period of 6 hours to melt the salts contained within the crucible thereby generating a fused salt electrolyte.

The fused salt electrolyte is purged in impurities by immersing a sacrificial copper substrate in the fused salt electrolyte and immersing a ¼ inch diameter consumable zirconium rod in the fused salt electrolyte. The sacrificial copper cathode is made cathodic to the zirconium rod inducing a current having the density of approximately 20 milliamperes per square centimeter measured at the surface of the sacrificial copper cathode.

A ¾ inch×2 inch×0.065 inch electrodeposition copper substrate is immersed in the fused salt electrolyte and made cathodic to a consumable zirconium electrode also immersed in the fused salt electrolyte. Current flows between the anodic zirconium and the cathodic copper electrodeposition substrate at a density of 5 milliamperes per square centimeter measured at the electrodeposition copper substrate. Electrodeposition is continued for 900 minutes in fused salt electrolyte maintained at approximately 795° C., and results in relatively smooth zirconium electrodeposit upon the copper substrate.

While a preferred method and embodiment of the invention has been shown and described in detail, it should be apparent that various alterations and modifications may be made therein without departing from the scope of the claims following.

What is claimed is:

1. A method for making an electrode for use in an electrochemical cell comprising the steps of:
   - selecting a substrate metal material and a valve metal material;
   - immersing the substrate in a fused salt electrolyte bath including the valve metal;
   - making the substrate metal cathodic whereby the valve metal is caused to electrodeposit upon the substrate;
   - controlling the temperature of the bath to be at least 550° C. and not greater than the alpha-beta transition temperature for the intermetallic of the substrate metal with the valve metal material;
   - discontinuing electrodeposition when the thickness of the thereby electrodeposited valve metal coating is not greater than 10 mils;
   - performing the electrodeposition in an inert atmosphere;
   - maintaining a current density of not greater than about 100 milliamperes per square centimeter at the substrate during electrodeposition; and
   - applying an electrocatalyst to the valve coated metal substrate.

2. A method for making an electrode for use in an electrolytic cell comprising the steps of:
   - selecting an electrode substrate from a group consisting of nickel, copper, gold, silver, iron and mixtures thereof and selecting a valve metal from a group consisting of titanium, aluminum, bismuth, niobium, tantalum, tungsten, zirconium and mixtures thereof;
   - immersing the substrate in a fused salt electrolyte bath including the valve metal;
   - making the electrode substrate cathodic whereby the valve metal is caused to electrodeposit upon the substrate;
   - controlling the temperature of the bath to be at least 550° C. and not greater than the alpha-beta transition temperature for the intermetallic of the substrate metal with the valve metal;
   - discontinuing electrodeposition when the thickness of the thereby electrodeposited valve metal coating is not greater than 10 mils;
   - performing the electrodeposition in an inert atmosphere;
   - maintaining a current density of not greater than about 100 milliamperes per square centimeter at the substrate during electrodeposition; and
   - applying an electrocatalyst to the valve coated metal substrate.

3. The method of claim 2, the current density being between about 5 and 25 milliamperes.

4. The method of claim 2, the bath temperature being between the alpha-beta transition temperature for the substrate metal-valve metal pair and 100 degrees below that transition temperature.

5. The method of claim 2, the substrate periodically being made anodic briefly whereby dendrite growth is controlled.

6. The method of claim 2, electrodeposition being stopped when the thickness of the electrodeposited valve metal coating is between about 2 and 8 mils.

7. The method of claim 2, the valve metal coated metal substrate being cleaned to remove substantially all residual fused salt electrolyted before applying the electrocatalyst.

8. A method for making an electrode for use in an electrochemical cell used for the manufacture of a halogen comprising the steps of:
   - immersing a copper electrode substrate in a fused salt electrolysis bath including titanium to be applied to the substrate;
   - making the substrate cathodic whereby the titanium electrodeposits upon the substrate;
   - introducing a ground state titanium into the bath in sufficient quantity to assure that substantially all titanium being electrodeposited from the bath is in the +3 valence state;
   - controlling the bath temperature to be between about 700° C. and 798° C.;
   - discontinuing the electrodeposition when the thickness of titanium electrodeposited on the substrate reaches not more than 10 mils;
   - performing the electrodeposition under an inert atmosphere;
   - maintaining a current density of not greater than about 100 milliamperes per square centimeter at the substrate during electrodeposition; and
   - applying an electrocatalyst to the coated substrate.

9. The method of claim 8, the current density being between about 5 and 25 milliamperes.

10. The method of claim 8, the electrodeposition being stopped when the thickness of the titanium coating is between about 2 and about 8 mils.

11. The method of claim 8, the copper substrate being made periodically anodic during electrodeposition, relatively briefly, whereby dendrite growth is controlled.

12. The method of claim 8, the titanium coated copper substrate being cleaned to remove substantially all residual salts from the electrolysis bath prior to applying the electrocatalyst.

13. The method of claim 8, the electrocatalyst being selected from a group consisting of platinum group metal oxides; tin, antimony, lead, and manganese oxides, valve metal oxides, and mixtures thereof.

14. A method for making a valve metal coating upon a conductive metal substrate, interdiffusionably joining the substrate and having a surface portion substantially free of the substrate metal comprising the steps of:
   - making the substrate cathodic within a fused salt electrolysis bath including the valve metal whereby the valve metal is caused to electrodeposit upon the substrate;
   - controlling the temperature of the bath to be at least 460° C. and not greater than the alpha-beta transition temperature for solid solutions of the substrate metal and the valve metal;

discontinuing electrodeposition when the thickness of the electrodeposit is not greater than 10 mils;

performing the electrodeposition under an inert atmosphere; and maintaining a current density of not greater than about 100 milliamperes per square centimeter at the substrate during deposition.

15. A method for making a valve metal coating upon a conductive metal substrate, interdiffusionably joining the substrate and having a surface portion substantially free of the substrate metal comprising the steps of:

making the substrate selected from a group consisting of copper, nickel, gold, silver, iron and mixtures thereof cathodic within a fused salt electrolysis bath including a valve metal selected from a group consisting of titanium, zirconium, bismuth, niobium, tantalum, tungsten, and mixtures thereof;

controlling the temperature of the bath to be at least 550° C. and not greater than the alpha-beta transition temperature for the intermetallic of the chosen substrate and the chosen valve metal;

discontinuing electrodeposition when the thickness of the electrodeposited coating is not greater than 10 mils;

performing the electrodeposition in an inert atmosphere; and maintaining a current density of not greater than about 100 milliamperes per square centimeter at the substrate during deposition.

16. The method of claim 15, the current density being between about 5 and 25 milliamperes.

17. The method of claim 15, the bath temperature being between the alpha-beta transition temperature for the substrate-valve metal pair and 100 degrees below that transition temperature.

18. The method of claim 15, the substrate periodically being made anodic briefly whereby dendrite growth is controlled.

19. The method of claim 15, electrodeposition being stopped when the thickness of the electrodeposited valve metal is between about 3 and 5 mils.

20. A method for electrolytically cladding a titanium coating upon a conductive copper substrate, the titanium interdiffusionably joined to the copper and having a surface portion substantially free of the substrate metal comprising the steps of:

making the copper substrate cathodic within a fused salt electrolysis bath including titanium to be clad upon the copper;

introducing ground state titanium into the bath in sufficient quantity to assure that substantially all titanium being electrodeposited from the bath is in the +3 valence state;

controlling the bath temperature to be between about 700° C. and 798° C.;

discontinuing the electrodeposition when the thickness of titanium electrodeposited on the substrate reaches not more than 10 mils;

performing the electrodeposition under an inert atmosphere; and maintaining a current density of not more than about 100 milliamperes per square centimeters at the substrate during electrodeposition.

21. The method of claim 20, the current density being between about 5 and 25 milliamperes.

22. The method of claim 20, the electrodeposition being stopped when the thickness is between about 2 and about 8 mils.

23. The method of claim 20, the substrate being made periodically anodic during electrodeposition, relatively briefly, whereby dendrite growth is controlled.

24. The method of claim 20, the coated substrate being cleaned to remove substantially all residual salts from the electrolysis bath prior to applying the electrocatalyst.

25. The method of claim 20, the clad substrate being cleaned of remaining residual salts from the electrolysis bath and then at least partially coated with an electrocatalytic substance.

26. An electrode for use in an electrochemical cell comprising: a conductive metal substrate, an electrodeposited valve metal cladding the substrate, an interdiffused zone of substrate metal and valve metal between the cladding and substrate, and an electrocatalyst applied to the cladding, the metal substrate being substantially free of the valve metal, and at least surface portions of the valve metal cladding being substantially free of the substrate metal.

27. An electrode for use in an electrochemical cell such as an electrolytic halogen generation cell comprising: an electrically conductive metal substrate, the conductive metal being selected from a group consisting of copper, nickel, iron, silver, gold, platinum and mixtures thereof; an electrodeposited valve metal cladding the substrate, the valve metal being selected from a group consisting of titanium, niobium, zirconium, tungsten, tantalum, bismuth and mixtures thereof; an interdiffused zone of substrate metal and valve metal between the cladding and substrate; and an electrocatalyst applied to surface portions of the cladding; the valve metal cladding being substantially free of the substrate metal and not greater than about 10 mils in thickness, the substrate metal being substantially free of the valve metal.

28. The electrode of claim 27, the substrate metal being one of copper and nickel, the valve metal being titanium.

29. The method of any of claims 1, 2, 8, 14, 15 or 20 including the step of purifying the fused salt electrolysis bath prior to applying the electrodeposited coating to the conductive substrate.

* * * * *